US006988594B2

(12) United States Patent
Deplazes et al.

(10) Patent No.: US 6,988,594 B2
(45) Date of Patent: Jan. 24, 2006

(54) ELEVATOR DOOR MONITORING SYSTEM

(75) Inventors: Romeo Deplazes, Oberrüti (CH); Philipp Angst, Zug (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/802,602

(22) Filed: Mar. 17, 2004

(65) Prior Publication Data

US 2005/0029055 A1 Feb. 10, 2005

Related U.S. Application Data

(63) Continuation of application No. PCT/CH02/00499, filed on Sep. 11, 2002.

(30) Foreign Application Priority Data

Sep. 18, 2001 (EP) ..... 01810904

(51) Int. Cl.
*B66B 1/34* (2006.01)

(52) U.S. Cl. ..... 187/393; 187/316

(58) Field of Classification Search ..... 187/247, 187/284, 291, 313, 316, 317, 391–399
See application file for complete search history.

(56) References Cited

U.S. PATENT DOCUMENTS

| | | | | |
|---|---|---|---|---|
| 4,512,442 | A * | 4/1985 | Moore et al. | 187/393 |
| 4,750,591 | A * | 6/1988 | Coste et al. | 187/391 |
| 4,930,604 | A * | 6/1990 | Schienda et al. | 187/393 |
| 5,644,111 | A | 7/1997 | Cerny et al. | |
| 5,760,350 | A * | 6/1998 | Pepin et al. | 187/316 |
| 6,173,814 | B1 | 1/2001 | Herkel et al. | |
| 6,484,125 | B1 * | 11/2002 | Huang et al. | 702/183 |
| 6,516,923 | B2 * | 2/2003 | Lence Barreiro et al. | 187/391 |
| 6,854,565 | B2 * | 2/2005 | Perala et al. | 187/393 |
| 2003/0121730 | A1 * | 7/2003 | Liu et al. | 187/391 |

FOREIGN PATENT DOCUMENTS

| | | |
|---|---|---|
| JP | 8-169673 | 7/1996 |
| JP | 9-077412 | 3/1997 |

* cited by examiner

*Primary Examiner*—Jonathan Salata
(74) *Attorney, Agent, or Firm*—Schweitzer Cornman Gross & Bondell LLP

(57) ABSTRACT

A monitoring system for monitoring doors such as a shaft or cabin door, of a lift installation includes a sensor element associated with the doors for monitoring the state or position of the door. An evaluation system is connected to the sensor element and evaluates the sensor signals. The evaluation system can perform continued evaluation in short time intervals in order to provide a continuous record of the state of the monitored doors and temporal changes in the signal characteristics of the sensor signals.

13 Claims, 1 Drawing Sheet

ELEVATOR DOOR MONITORING SYSTEM

The invention relates to a monitoring system for monitoring a shaft door or cage door of a lift system. The present application is a continuation of PCT/CH02/00499 filed Sep. 11, 2002.

BACKGROUND OF THE INVENTION

Lift systems these days comprise so-termed double doors, i.e. not only shaft doors, but also cage doors arranged at the lift cage. The opening and closing of the shaft doors is usually carried out by the cage or the cage doors. For reasons of safety, during lift operation all shaft doors must always be closed, with the exception of the shaft door of that story at which the lift cage has just stopped. Similarly, the cage doors must be closed when the lift is not stopped at a story in order to be loaded or unloaded or to be entered or left. For maintenance reasons the shaft doors and/or cage doors can obviously also be opened when the lift cage is located otherwise than in the above-described positions. The state, i.e. the setting, of the shaft doors and cage doors, or the setting of locks by which the shaft doors and/or cage doors are lockable in their closed settings, are monitored with the help of monitoring systems. For this purpose, sensor means, for example in the form of guided devices with safety contact positions, are provided. The safety contact positions are integrated in a series connection in a safety circuit. The arrangement is such that the lift cage can be moved only if the safety circuit and thus all safety contacts integrated therein are closed.

Monitoring systems with safety circuits of this kind are subject to numerous disadvantages, which are briefly listed in the following:

- Each safety circuit has inherent problems; including the length of the connections, the voltage drop in the safety circuit and the relatively high assembly cost.
- The individual safety contacts are comparatively susceptible to failure; unnecessary emergency stops of the lift system therefore frequently occur.
- Notwithstanding a monitoring system with a safety circuit, unsafe or risky situations cannot be avoided; on the one hand the safety contacts individually or in common can be relatively easily bridged over, which is virtually equivalent to the absence of safety precautions, and on the other hand, while an open shaft door does indeed prevent movement of the cage, if the cage is not disposed at the then open shaft door the risk still exists of a fall through the open shaft door.
- Intelligent or situation-appropriate reactions, for example in the case of an open safety circuit, are not possible; in particular, it cannot be avoided that persons are unintentionally trapped in the lift cage.
- The monitoring system does not permit a specific diagnosis, i.e. in the case of an open safety circuit it can only be established that at least one safety contact and thus one lock or at least one shaft door is open. It cannot be established, however, which safety contact or contacts is or are open.
- A precautionary maintenance is not possible, since there are no indications about the state of the safety contacts; it is thus not possible to service the lift system in advance and to replace worn safety contacts in good time, and at a point in time in which the lift system can be shut down without problems, except within the scope of a periodic inspection wherein, however, in many cases taking the lift system out of operation, which is not necessary as such, is carried out.
- The availability of the lift is restricted, since an open safety contact always has the consequence of taking the lift system out of operation even if another solution, for example blocking the access region to a non-closable shaft door, would be possible.

The object of the invention is thus to provide an improved monitoring system of the kind stated in the introduction, by which the disadvantages of the state of the art can be avoided or at least significantly reduced. In particular, the detection of the state of the shaft doors or cage doors by the sensor means shall be able to be analyzed and capable of diagnosis. Moreover, gradual deteriorations of individual subsystems shall be capable of recognition so that preventative maintenance can be initiated in good time.

A further object of the invention is to provide a new monitoring system in which disturbances or failures of individual contacts do not lead to failure of the entire lift system.

BRIEF DESCRIPTION OF THE INVENTION

The foregoing and other objects are met by a monitoring system in accordance with the invention for a lift system in which the shaft doors and/or the cage doors have sensor means by which their state, i.e. the adoption of their open setting or closed setting, is detected. The monitoring system further comprises an evaluating system which is connected with the sensor means and which evaluates the signals delivered by the sensor means. This evaluation is carried out at short intervals in time and makes it possible to detect the state of the monitored shaft door or cage door; similarly, changes of the signal characteristic over time are detected.

The advantages achieved by the monitoring system according to the invention are the following:

In contrast to a system with a safety circuit, it is not only possible to establish that a fault has occurred, but the evaluating unit can also localize a fault from the signals of the sensor means and thus an analysis and diagnosis relating to the fault is possible. In addition, through the evaluation of the signal characteristics of the signals delivered by the sensor means, diminutions in quality over time can be detected so that precautionary maintenance measures can be initiated.

The evaluating system is preferably so constructed that it can, in particular, recognize and localize a fault and/or can establish a defect of a sensor means and/or can establish whether sensor means are worn and/or can recognize faulty manipulations at the shaft door associated with a specific sensor means and/or can recognize the necessity of maintenance and/or can recommend maintenance.

In a first construction one evaluating system can be provided per story; this evaluating system is preferably connected by way of a data bus with a lift control.

In a second embodiment a common evaluating system can be provided for several stories; such an evaluating system is also preferably connected by way of a data bus with a lift control.

In one preferred monitoring system the evaluating system comprises a local processor in order to evaluate the signals of the sensor means.

In a particularly favourable the evaluating system of the new monitoring system also processes other signals or data of the lift installation, i.e. other lift magnitudes. In this manner, for example, a redundancy in the lift system can be utilized in that, for example, on the one hand a sensor means indicates the closed setting of a cage door and on the other hand an incremental transmitter of the door drive similarly detects the closed setting of the cage door.

It is of greatest advantage if the evaluating system is so conceived that it also detects the changes in signal characteristics over time, i.e. the characteristics of the signals to be evaluated; abnormal bounce behaviour of sensor means or abnormal dynamic signal courses and/or abnormal static states, for example a voltage drop, at a sensor means can thereby be detected. It is thus possible to carry out diagnoses at the level of individual components and to arrange advance maintenance of individual sensors.

It is worthy of recommendation to select a sensor means which comprises at least two redundant sensors; a failure of a single sensor leads to failure of the entire lift system which is equipped with the new monitoring system can thereby be prevented; the lift system can remain in operation at least temporarily if a sensor of a sensor means is no longer functionally operable.

A particularly favorable sensor means comprises two sensors which are so arranged in the region of a shaft door or the cage door that, during closing or opening, or during the change in the state of the shaft door or the cage door, a first one of the two sensors and later, displaced in time, the second of the two sensors delivers a signal. It can be provided, for example, that the first sensor delivers a signal when a shaft door or cage door is closed to a residual door gap, for example 10 mm, and that the second sensor delivers a signal when the shaft door or cage door is completely closed and locked. In this manner it can be recognized whether a shaft door or cage door closes completely or no longer completely closes due to contamination, mechanical wear or deformation, and a diagnosis at the level of the subsystems of the shaft doors or cage doors can be obtained. The monitoring system can be so configured that operation interruption does not take place when the residual door gap does not exceed a limit value, but that at the same time a service call is generated.

After evaluation of the signals, and optionally the signal characteristics, the evaluating system advantageously triggers at least one predefined reaction, especially localization of a fault and/or generation of a service call and/or storage of diagnostic information and/or stopping of the lift cage or execution of another situation-dependent reaction if a shaft door was recognized as open.

In a further preferred construction of the monitoring system an evaluating system, is present at each cage door, or at least at each cage, which is preferably connected with a lift control by way of a data bus.

BRIEF DESCRIPTION OF THE DRAWINGS

The present invention is described in more detail in the following on the basis of illustrative exemplary examples of embodiments and with reference to the drawing, in which.

DETAILED DESCRIPTION OF THE INVENTION

Figure 1:
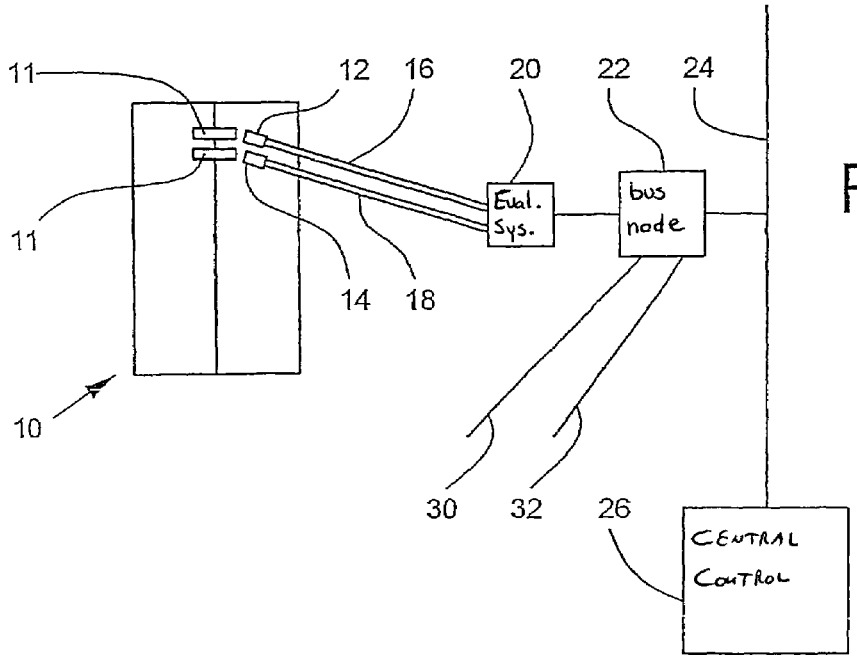
FIG. 1 is a substantially simplified schematic representation of a shaft door or cage door of a lift system with a first monitoring system according to the invention.

FIG. 1 shows an arrangement with decentralized evaluation. A lift system, which is not illustrated in more detail, comprises a door 10, which can be a shaft door or a cage door. Sensor means, namely a first sensor means 12 and a second sensor means 14, are associated with the door 10. Each of the sensor means 12, 14 has one or more sensors (not shown) which, in the present example of embodiment, are constructed as switches and are actuable by way of door elements 11. The sensor means 12, 14 are connected by way of connections 16, 18 to an evaluating system 20 which is intended only for the evaluation of the signals of the door 10. The evaluating system 20 is connected by way of a bus node 22 to a data bus 24, which is connected to a central control 26. In addition to the signals delivered by the sensor means 12, 14, other signals, i.e. other lift magnitudes, are connected to the bus node 22 by way of further connections 30, 32; in addition, a connection to the evaluating system or to an integrated computer, which is not illustrated, can be made. The evaluating system 20 can also be integrated in the bus node 22.

Figure 2:
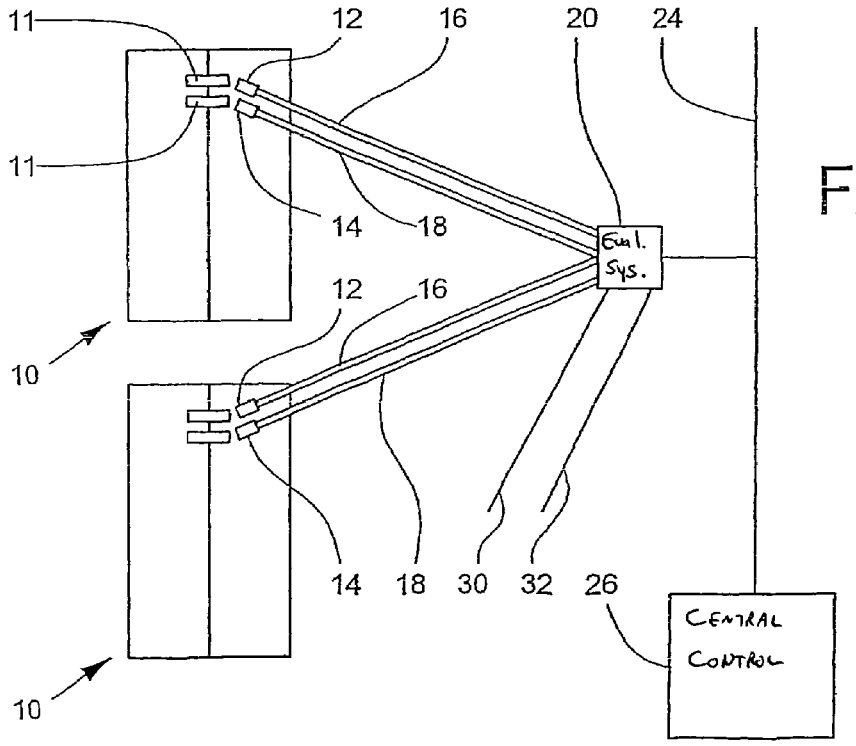
FIG. 2 is a similar form of representation, depicting two shaft or cage doors of a lift system with a second monitoring system according to the invention.

FIG. 2 shows an arrangement with central evaluation. In a lift system which is not illustrated in more detail, there is shown a first door 10 and a further, second door which is also denoted by 10. Sensor means, namely a first sensor means 12 and a second sensor means 14, are associated with each of the doors 10. Each of the sensor means 12, 14 has one or more sensors (not shown), which in the present example of embodiment are constructed as switches and actuable by way of door elements 11. The sensor means 12, 14 of the doors 10 are each connected by way of two connections 16, 18 to the evaluating system 20, which is intended for evaluation of the signals of the two doors 10. The evaluating system 20 is connected to a data bus 24, which is connected to a control 26. In addition to the signals delivered by the sensor means 12, 14, other signals, i.e. other lift magnitudes, are connected to the evaluating system 20 by way of further connections 30, 32; in addition, a connection to an integrated computer, which is not illustrated, can be made.

The overall results of the above-described arrangements of FIGS. 1 and 2 are substantially the same. The sensors, which are constructed as switches, of the sensor means 12, 14 co-operate with the door elements 11 of the doors 10. The signals generated by the sensor means 12, 14 describe the switching states of the corresponding switches which form the sensors of the sensor means 12, 14; these switching states correspond with the states or settings of the door 10, i.e. they indicate each time whether the door 10 is open or closed. Moreover, signal characteristics result from the signals emanating from the sensors. The signals and signal characteristics are evaluated in the evaluating system 20. Appropriate reactions are initiated on the basis of the results of the evaluation; such measures may be, for example, generation of a precautionary service call, storage of diagnostic information or shutting down of the lift system. The evaluation can, according to FIG. 1, be carried out per door, thus decentrally, or according to FIG. 2 for several doors, thus centrally.

In the case of use of a data bus the evaluation of the signals can also be undertaken by the bus nodes. The bus nodes in this case thus also form the evaluating system. There is then transmitted to the central control, for example, not a qualified statement or diagnosis, but only a status, for example the communication 'switch closed/diagnosis in order'.

In principle it is also possible to dispense with a data bus and to directly connect each sensor individually by wire with the central control unit; the assembly cost, however, is then significantly greater.

We claim:

1. A monitoring system for a lift installation having at least one of a shaft door or cage door to be monitored, comprising: at least one sensor means for monitoring the state of the monitored door and an evaluating system connected to the sensor means for evaluating signals made available by the sensor means for evaluating signals of the sensor means at short intervals in time in order to detect the state of the monitored door and the condition of the sensor system as reflected by changes over time of a signal characteristic of the signals of the sensor means.

2. The monitoring system according to claim 1, wherein the evaluating system includes means for detecting at least one of the following states:

i. recognition and localization of a fault, ii. sensor means defect or failure, iii. sensor means wear, iv. faulty manipulation of the shaft door in a region in which the sensor means is disposed, v. maintenance needed, or vi. maintenance recommended.

3. The monitoring system according to claim 1 or 2, wherein an evaluating system is present for each story.

4. The monitoring system according to claim 1 or 2, wherein an evaluating system is present for several stories in common.

5. The monitoring system according to claim 1 or 2, wherein the evaluating system is integrated in a bus node of a data bus.

6. The monitoring system according to claim 1 or 2, wherein the evaluating system has a local processor in order to undertake evaluation of the signals of the sensor means.

7. Monitoring system according to claim 1 or 4, wherein the evaluating system also processes signals of an incremental position transmitter at a door drive.

8. The monitoring system according to claim 1 or 2, wherein the evaluating system includes means to detect at least one of changes over time of a signal characteristic in order to recognize abnormal bounce behavior of the sensor means; abnormal dynamic signal courses such as bounce behavior of the sensor means; and abnormal static signal states at the sensor means.

9. The monitoring system according to claim 1 or 2, wherein in that the sensor means comprises two or more redundant sensors.

10. The monitoring system according to claim 1 or 2, wherein the sensor means each comprise two sensors which are arranged in a region of at least one of the shaft door and cage door in such a manner that during closing of the respective door initially one of the two sensors and then, displaced in time, the second of the two sensors makes available a signal.

11. The monitoring system according to claim 8, wherein the evaluating system includes means for evaluating the signals and the signal characteristic so as to be able to trigger one or more of the following predefined reactions:

localization of a fault;

triggering of a service call;

storage of diagnostic information; or upon recognition of a staying open of a shaft door, stopping lift cage or executing a situation-dependent reaction.

12. The monitoring system according to claim 10 wherein at least one evaluating system is present for each story.

13. The monitoring system according to claim 10, wherein an evaluating system is present for several stories in common.

* * * * *